United States Patent [19]

Monoyios

[11] Patent Number: 4,927,150

[45] Date of Patent: May 22, 1990

[54] SHIFTABLE BLOCK PUZZLE

[76] Inventor: Terry Monoyios, 323 Alten, N.E., Grand Rapids, Mich. 49503

[21] Appl. No.: 192,843

[22] Filed: May 11, 1988

[51] Int. Cl.[5] ..... A63F 9/08

[52] U.S. Cl. ..... 273/153 S

[58] Field of Search ..... 273/153 S

[56] References Cited

U.S. PATENT DOCUMENTS

| | | | |
|---|---|---|---|
| 1,112,746 | 10/1914 | Wiley | 273/153 S |
| 2,208,753 | 9/1965 | Stotts | 273/153 S |
| 4,269,414 | 5/1981 | DeVos et al. | 273/153 S |
| 4,422,641 | 12/1983 | Collin | 273/153 S |
| 4,452,454 | 6/1984 | Greene | 273/153 S |
| 4,548,410 | 10/1985 | Morrone | 273/153 S |
| 4,667,960 | 5/1987 | Stefanini | 273/153 R |

FOREIGN PATENT DOCUMENTS

| | | | |
|---|---|---|---|
| 81617 | 6/1983 | European Pat. Off. | 273/153 S |
| 592536 | 9/1947 | United Kingdom | 273/153 S |

*Primary Examiner*—Anton O. Oechsle

*Attorney, Agent, or Firm*—Waters, Morse & Harrington

[57] ABSTRACT

A shiftable block puzzle comprising a frame with means for retaining a plurality of shiftable blocks and at least one object piece and with allowance for perpendicular movements. The shiftable blocks remain on the playing surface, whereas the object piece is selectively removable or insertable through at least one opening in the frame.

2 Claims, 2 Drawing Sheets

SHIFTABLE BLOCK PUZZLE

BACKGROUND OF THE INVENTION

The invention relates to a shiftable block puzzle, where a plurality of shiftable block pieces are retained by a frame, yet are free to move in lateral directions. Typically, one of the shiftable block pieces is designated the object piece, and the solution to the puzzle requires the relocation of the object piece from its start position to a predetermined end position.

More specifically, the present invention relates to a shiftable block puzzle where the object piece can be physically removed, or escape from the playing surface by exiting through a compatible opening disposed about the side of the frame. Additional openings may be employed in the frame or near the start position, such that the object piece may be relocated to begin the game anew once the block pieces are reshuffled to original positions.

Other shiftable block puzzles are known where a number of different sized block pieces are used, along with a designated object piece. The typical goal in solving the puzzle is the relocation of the object piece from a start position to an end position, but the object piece remains attached to the playing surface. In order to begin the game at this point, it is required that the puzzle be solved in reverse.

SUMMARY OF THE INVENTION

In accordance with the present invention, a shiftable block puzzle comprises a plurality of uniform or different sized shiftable block pieces retained in a frame yet free to move in perpendicular directions. Typically, one shiftable block is designated the object piece. At least one opening is disposed along one of the sides of the frame and is of sufficient width and configuration so as to allow the entry or the exit of the object piece.

Another feature of the present invention is the slidable restraint of the shiftable blocks other than the object piece. A depending member engages corresponding channels in the floor of the frame allowing perpendicular movements while preventing removal of the shiftable blocks. The object piece may be restrained by the use of tongue and groove means found on the sides of all of the shiftable block pieces. As indicated above, the object piece may be moved into position near an opening in the frame and exit the playing surface as part of the solution of the puzzle.

Another advantage of the present invention is the optional use of an entry opening in the frame, such that the object piece may be reinserted into the start position and the game recommenced after the shiftable blocks have been reshuffled to original locations. As compared to those puzzles known in the art, this represents an improvement by eliminating the need to solve the puzzle in reverse once the object piece has been moved to its end position.

The usage of different sized shiftable blocks increases the complexities involved in the solving of the puzzle. While shiftable blocks of uniform size may be utilized, the increased challenge and the varied strategies available with the use of different sized shiftable blocks results in a superior game.

The embodiments of the present invention may be analogized to different escape scenarios for the purposes of increasing the entertainment value of the puzzle. For example, the objective of the game may be defined as the escape of a prisoner from his guards, or the escape of a fox from the hounds.

These and other advantages and features of the present invention will hereinafter appear and for purposes of illustration, but not of limitation, preferred embodiments of the present invention are described in detail below and in the appended drawings.

DESCRIPTION OF THE PREFERRED EMBODIMENTS

Figure 1:
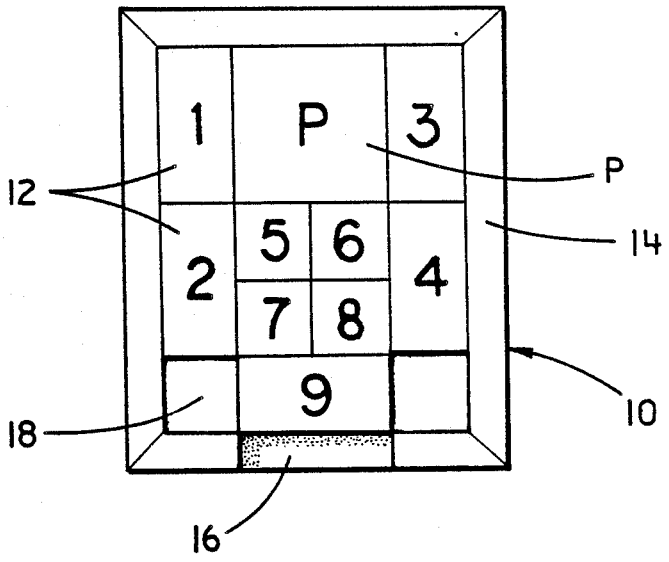
FIG. 1 is a plan view of a shiftable block puzzle.

Referring now to FIG. 1, a shiftable block puzzle 10 is shown with shiftable blocks 12(1) through 12(9) arranged within frame 14. The shiftable blocks present a flat surface that is substantially flush with the surrounding edges of the frame. The floor 18 is shown partially exposed in the drawing and may be formed integrally with the frame or exist separately as a component part. The floor represents the primary surface that supports and contacts the shiftable blocks and the object piece which are free to slide on the surface of the floor. The shiftable blocks may be uniform in shape, although the preferred usage is to employ different sized blocks so as to increase the complexity and challenge of solving the puzzle.

The movement of all pieces of the present invention are herein defined as occurring in perpendicular directions. Specifically, the pieces are oriented in substantially planar fashion, the plane being describable along an X-axis and a Y-axis. Thus all movements of puzzle pieces are limited to those parallel to either the X-axis or the Y-axis. No diagonal or non-linear movements are allowed.

In the present invention, a single object piece "P" is used. The object piece is shown in FIG. 1 in the start location. The objective of the game is defined as the stepwise movement of the object piece from the start position to the designated end position. In order to achieve this, the shiftable blocks and the object piece are free to move in perpendicular directions, yet are otherwise restrained within the same plane described by the frame. The ability to move the shiftable blocks and the object piece relies on enough unoccupied space within the frame to account for any desired moves. In the present embodiment, the shiftable blocks and object piece are rectangular, flat pieces that lie on the surface of the floor by means of gravity alone.

The shiftable block puzzle is preferably constructed from wood or plastic materials. It is feasible to mold the frame and floor together as one part using plastic, thus reducing manufacturing costs related to assembly of components. It may be desired in some cases to fabricate the floor from metallic materials, especially where the shiftable blocks and object piece are fabricated with magnetic materials. In that case, the blocks and object piece would be held to the surface of the floor by the magnetic attraction.

Figure 2:
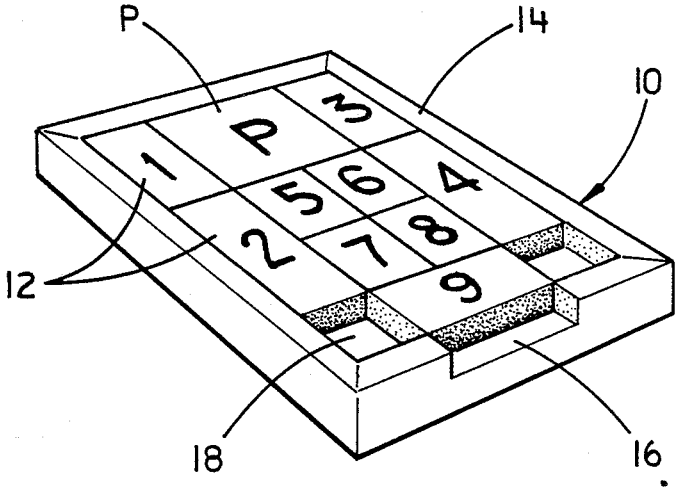
FIG. 2 is a perspective view of a shiftable block puzzle.

As can be seen in FIG. 2, the shiftable blocks and object piece reside within the frame of the present invention and may be moved in various manners to occupy the vacant spaces depicted generally on either side of shiftable block 12(9). In playing the game of the present invention, the goal is to transition the object piece towards the opening 16 in the frame. The width of the opening is slightly larger than the width of the object piece, thus allowing the removal of the object piece from the puzzle when the goal is achieved. In the usual game, a series of moves and dislocations of the shiftable blocks will be necessary in order to position the object piece adjacent the opening. The strategy of the game thus relies on the combination of moves required to provide clearance for the successful positioning of the object piece. In the present embodiment, the object piece may be returned to the start location by physically reinserting the piece onto the surface of the floor at that location.

The scenario that may be developed for the present invention can be likened to that of an escape game where the object piece is a prisoner and the blocks are guards, or as in the case where the object piece is the fox, and the blocks are pack of hounds. The physical removal of the object piece complements the scenario to the extent it is symbolic of the desired objective.

Embodiment No. 2

Figure 3:
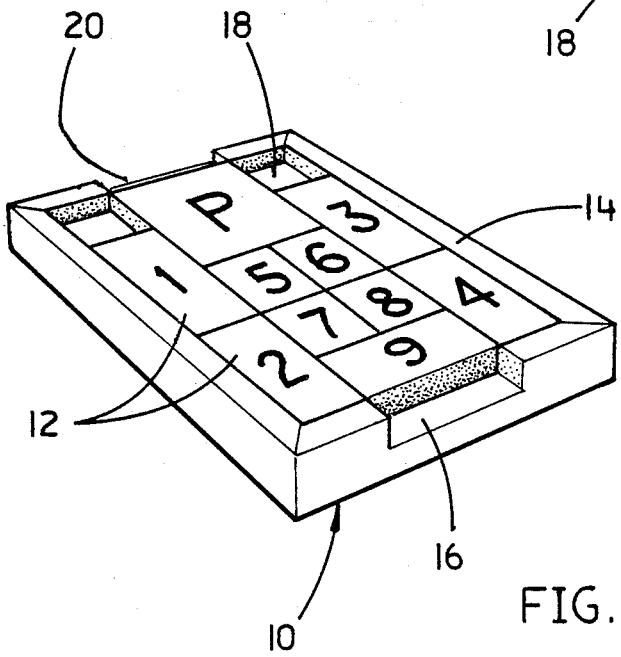
FIG. 3 is a perspective view of a shiftable block puzzle with two openings in the frame.

A modification of the present invention is shown in FIG. 3 where an additional entry opening 20 is provided near the designated start location of the object piece. This modification allows for reinsertion of the object piece in the start location. The entry opening becomes more important if the shiftable blocks are permanently connected to the floor of the puzzle. This feature enhances the previously mentioned scenarios involved in playing the game.

Embodiment No. 3

Figure 4:
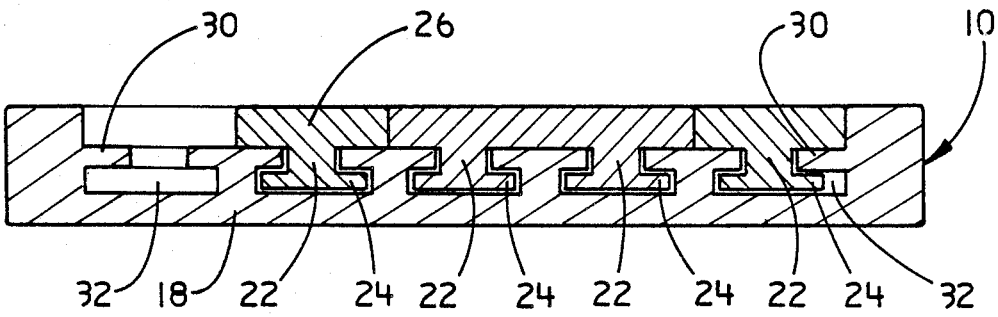
FIG. 4 is a cross-sectional view of a portion of a shiftable block puzzle.
Figure 5:
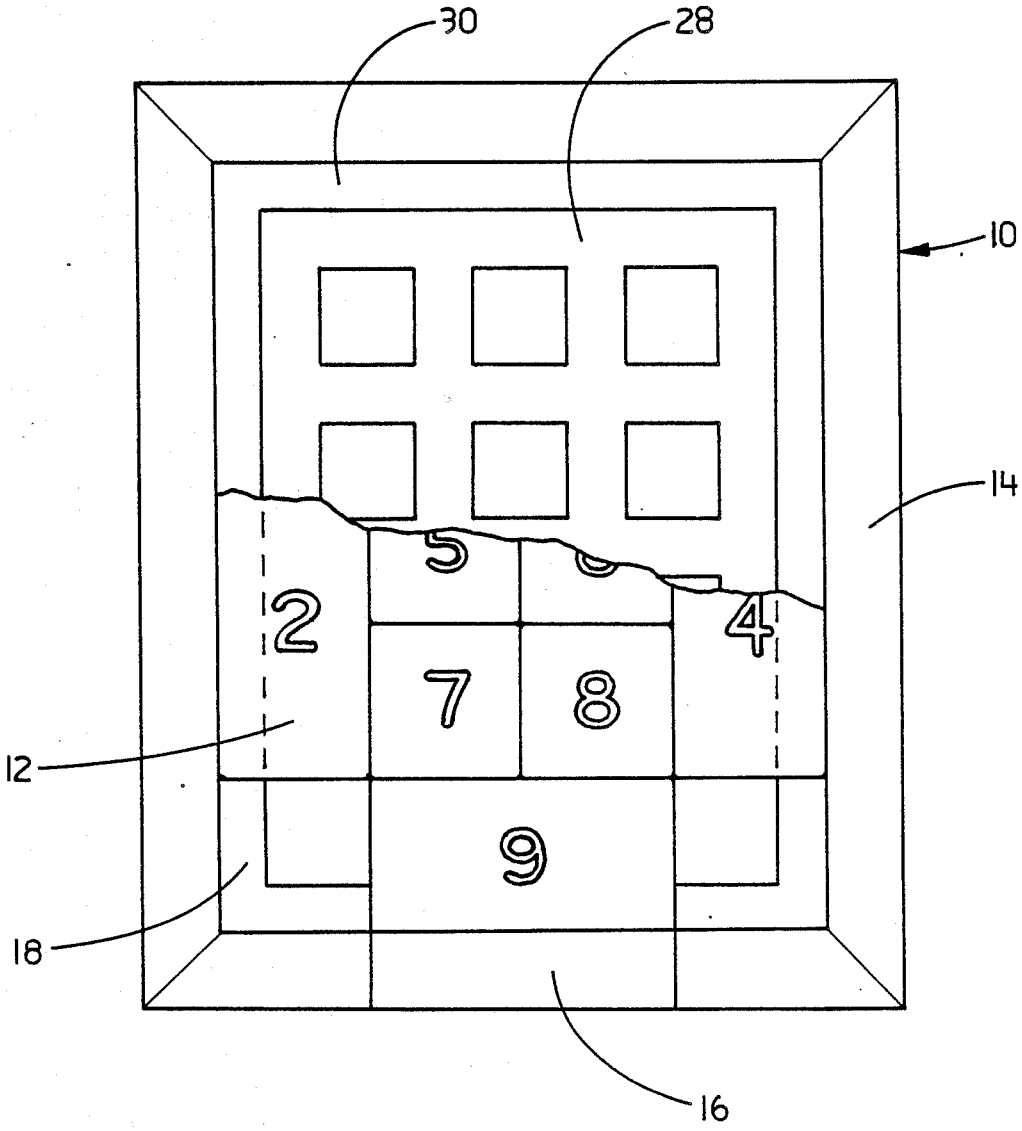
FIG. 5 is a plan view of a shiftable block puzzle with underlying features exposed.

The shiftable block puzzle shown in FIG. 5 maintains the basic attributes of the previous embodiments but includes the modifications to the floor of the puzzle which are shown as channels 28. The channels can also be seen in FIG. 4 in relation to a modified shiftable block with a surface part 26, a depending anchor strut 22 and anchor part 24. The anchor travels within the void 32 found between the outer casing 30 and the floor 18. The width of the anchor strut is narrow enough to travel within the channels. In this manner the shiftable block is allowed to travel perpendicularly within the frame of the puzzle, yet it remains permanently anchored.

The object piece, in this embodiment, remains essentially rectangular with no permanent connection or restraint. The object piece not being connected to the puzzle can be transitioned to the openings and removed from the puzzle. Of some consequence in this embodiment is the usage of the entry opening which allows the quick and convenient reinsertion of the object piece in the start position. With the object piece removed from the playing surface, the reshuffling of the remaining pieces to original locations is facilitated. This feature is an improvement over the known puzzles since the tedium involved in the reverse solution of the puzzle is aggravating and not as enjoyable as the challenge offered by the elegant resolution of the puzzle in the original configuration.

In the case of all the above embodiments, the method of retaining the object pieces or the shiftable blocks to the frame can be modified without affecting the principle and spirit of the present invention. In addition, the number of object pieces may be increased, their size altered, or other changes to the shiftable blocks in terms of size, number, or appearance can be made without departing from the spirit and scope of the present invention.

The embodiments of the invention in which an exclusive property or privilege is claimed are defined as the following:

1. In a sliding block puzzle comprising a playing surface including formed channels therein surrounded by a rectangular frame, a plurality of rectangular playing pieces slidably positioned on the playing surface, said playing pieces including depending projections that fit into said channels, the projections further including extending portions below the playing surface that compatibly prevent the pieces from being vertically removed from the playing surface while allowing for slidable movement of the playing pieces through said channels in the playing surface, the size of the playing pieces being such that the pieces are positioned contiguously and fill the frame, with the exception that there is at least one vacant space inside the frame such that the playing pieces are slidable in perpendicular directions inside the frame and into the vacant spaces to change relative positions of the pieces on the playing surface, the improvement wherein an object piece is also slidably positioned on the playing surface, said object piece not having a depending projection and therefore being free to be removed from the playing surface, and further where the frame includes at least one opening therein at a predetermined location, the object piece being slidable through the opening allowing the exit of the object piece from the playing surface when the object piece is slidably manipulated to a position on the playing surface adjacent the opening.

2. A puzzle according to claim 1, where there are two openings within the frame at predetermined locations corresponding to an entry opening for the insertion of the object piece onto the playing surface at the commencement of the game, and an exit opening for the removal of the object piece from the playing surface at the conclusion of the game.

* * * * *